M7219 XR 3,964,553

United States Patent [19]

Basham et al.

[11] 3,964,553

[45] June 22, 1976

[54] BOREHOLE TOOL ORIENTING APPARATUS AND SYSTEMS

[75] Inventors: Edward R. Basham; William D. Smith, both of Fort Worth, Tex.

[73] Assignee: Go International, Inc., Fort Worth, Tex.

[22] Filed: Sept. 4, 1975

[21] Appl. No.: 610,284

[52] U.S. Cl. ..... 175/4.51; 33/304; 166/55.1; 166/65 M

[51] Int. Cl.[2] ..... E21B 43/119; E21B 43/11

[58] Field of Search ..... 166/55, 55.1, 65 M, 166/255; 175/4.51; 33/302, 304, 310

[56] References Cited

UNITED STATES PATENTS

| | | | |
|---|---|---|---|
| 3,032,107 | 5/1962 | Bumble et al. | 175/4.51 |
| 3,105,546 | 10/1963 | Ownby et al. | 166/65 M |
| 3,105,550 | 10/1963 | Ehlert | 166/65 M |
| 3,154,147 | 10/1964 | Lanmon | 166/255 |
| 3,294,163 | 12/1966 | Lebourg | 166/255 |
| 3,307,642 | 3/1967 | Smith | 175/4.51 |
| 3,426,850 | 2/1969 | McDuffie, Jr. | 166/255 |
| 3,704,749 | 12/1972 | Estes et al. | 166/255 |

*Primary Examiner*—James A. Leppink
*Attorney, Agent, or Firm*—Wofford, Felsman, Fails & Zobal

[57] ABSTRACT

Borehole orienting apparatus is provided wherein motion is imparted to a permanent magnet assembly to generate a moving magnetic field and receiver means are provided such that measurable signals are induced therein when the magnetic field is distorted due to the presence of a ferrous anomaly. The receiver means is rotated to produce an azimuthal scan such that there are induced in the receiver means signals from which the azimuthal location of the anomaly can be determined.

12 Claims, 7 Drawing Figures

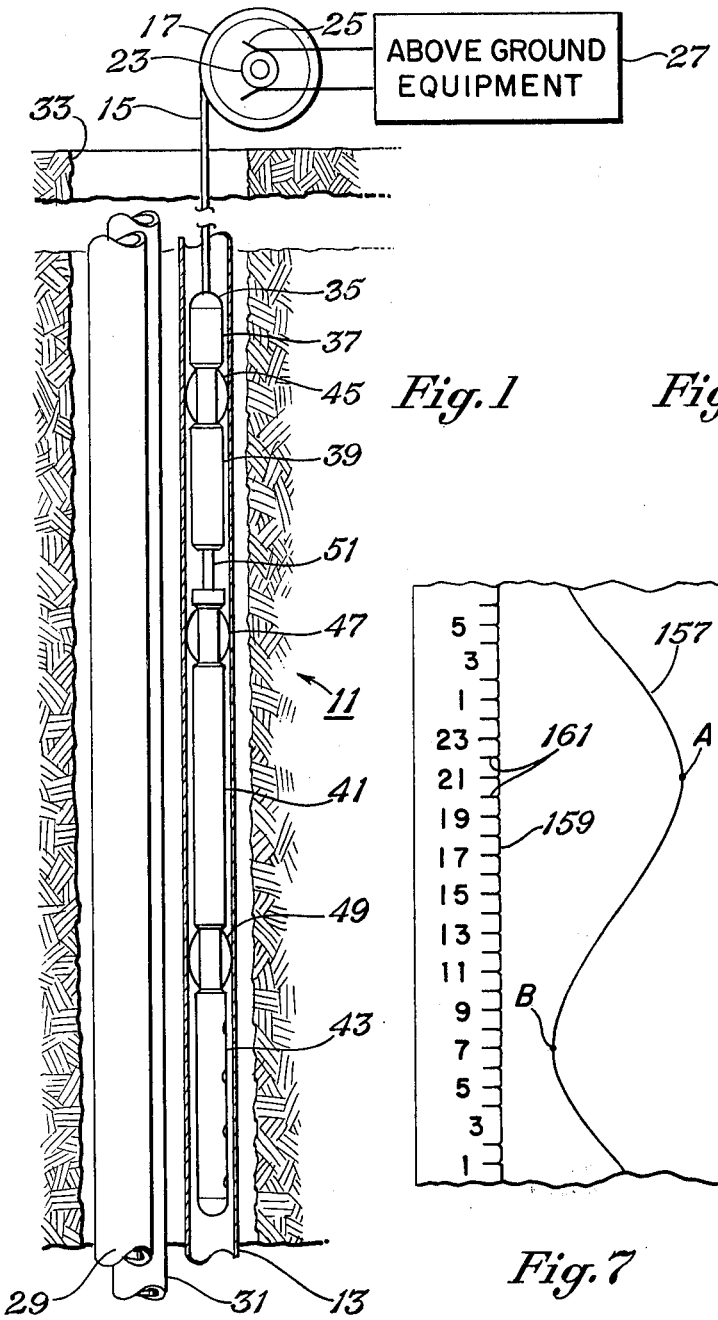
Fig. 1
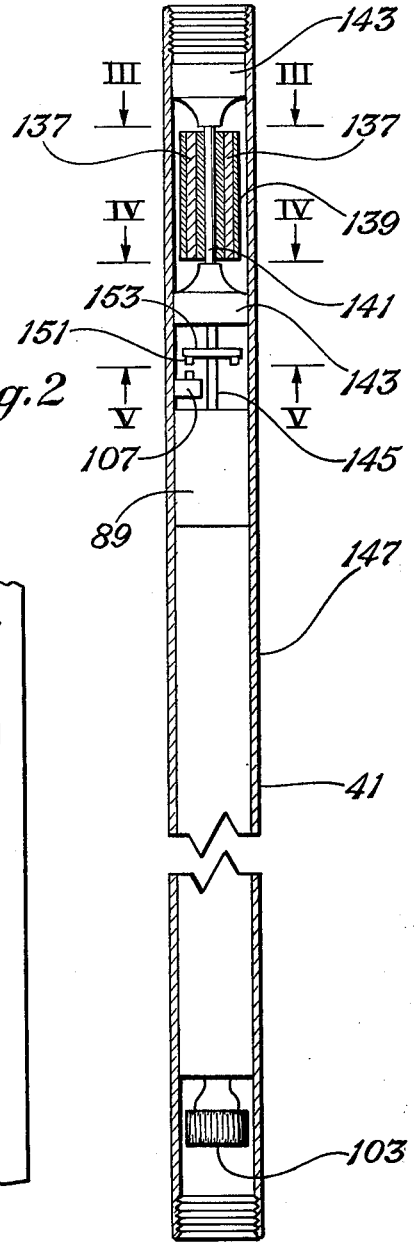
Fig. 2
Fig. 7
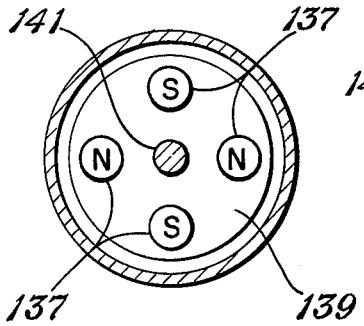
Fig. 3
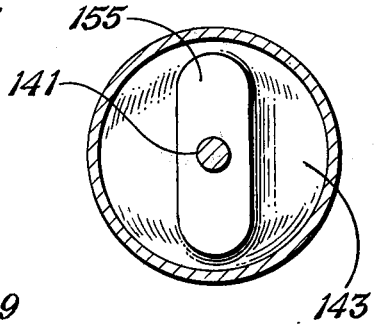
Fig. 4
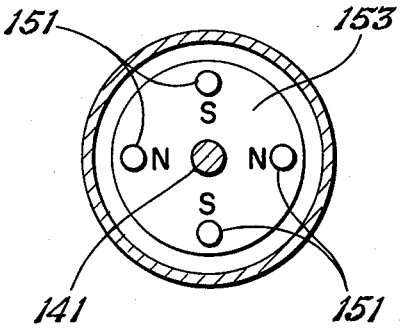
Fig. 5

BOREHOLE TOOL ORIENTING APPARATUS AND SYSTEMS

FIELD OF THE INVENTION

The present invention relates to apparatus for orienting tools in boreholes, and more particularly to apparatus and systems wherein a tool is orientable relative to phenomena indicative of an azimuthal pattern.

BACKGROUND OF THE INVENTION

In earth formations traversed by a borehole and wherein there are a plurality of petroleum bearing strata at different borehole depths, it is common practice to insert a plurality of tubing strings into the uncased borehole and then, by cementing the borehole, to isolate the strata outside the tubing strings from each other so that there may be provided a plurality of petroleum production zones. Multiple completion wells may in some cases involve many producing zones; with two to four producing zones being quite common. Tubing strings are usually run so that within a given production zone there may be a plurality of tubing strings. After the tubing strings are installed and cemented, it is necessary to perforate the tubing string that is to carry the output of a particular production zone. This perforating is accomplished by lowering a perforating device (usually a shaped charge gun) within the tubing string to be perforated, then, orienting the device so that only the desired tubing string will be perforated, and then actuating the perforating device. It is essential in every case that the perforating device shall be fired so as to avoid perforation of any other tubing string.

Various types of orienting devices have been utilized in the prior art. Among these are devices which employ an electromagnetic field as the phenomena indicative of an azimuthal pattern, as disclosed, for example, by U.S. Pat. No. 3,704,749. The electromagnetic field is generated by use of an excitor coil, and the alternating current power for the excitor coil is usually transmitted from above ground to the downhole tool via the single conductor cable or wire line from which the downhole tool is suspended. The presence of alternating current on the wire line presents certain safety problems, since the perforator gun is usually detonated by a negative signal that is transmitted to the downhole tool via the wire line. To resolve such safety problems to an acceptable degree requires measures which increase the complexity of the downhole tool.

It is an object of this invention to provide a borehole orienting tool which does not require the transmission of alternating current power via the wire line to the downhole tool.

Another object of the invention is to provide improved borehole orienting apparatus and systems.

These and other objects are effected by the invention as will be apparent from the following description taken in accordance with the accompanying drawings, forming a part of this application.

BRIEF DESCRIPTION OF THE DRAWINGS

FIG. 1 is a diagramatic showing of the general layout of a perforator orienting apparatus and system utilizing the present invention, with the downhole portion of the apparatus disposed inside a tubing string in a typical multiple completion well;

FIG. 2 is an enlarged fragmentary longitudinal section view showing in schematic form certain details of the magnetic tool section of the downhole assembly of FIG. 1;

FIG. 3 is a schematic sectional view taken at line III—III of FIG. 2;

FIG. 4 is a schematic sectional view taken at line IV—IV of FIG. 2;

FIG. 5 is a schematic sectional view taken at line V—V of FIG. 2;

DESCRIPTION OF PREFERRED EMBODIMENT

Figure 6:
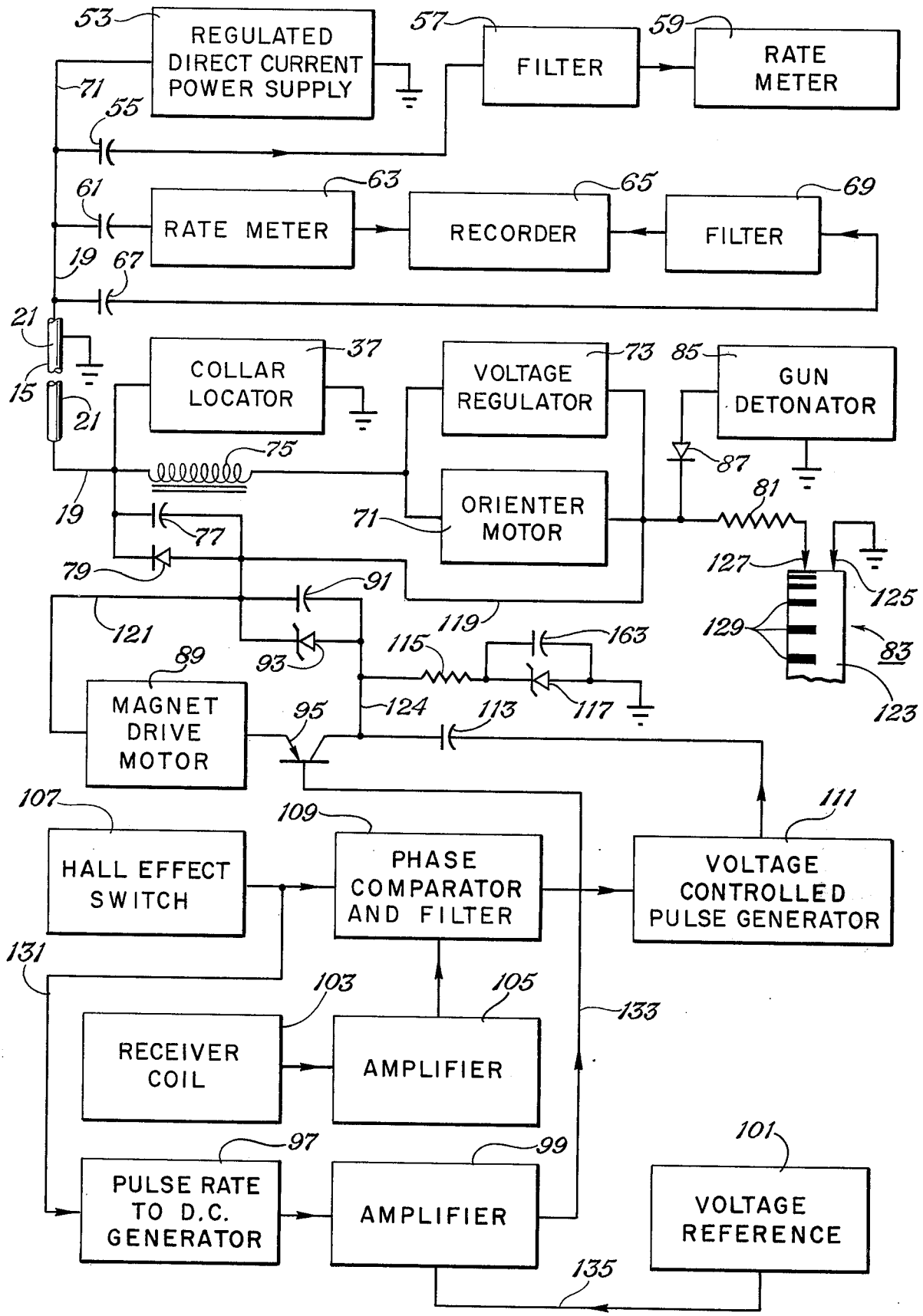
FIG. 6 is a schematic electric circuit diagram of the perforator orienting apparatus and system in accordance with a preferred embodiment of the invention; and, FIG. 7 is a graph showing in schematic form a typical strip chart produced by the apparatus of FIGS. 1 and 6.

Referring now to the drawings, in FIG. 1 there is shown a typical down-hole assembly 11 suspended within a tubing string 13 by means of a cable 15 which is reeled off a conventional cable drum 17 which is powered and controlled by conventional means (not shown). The cable 15, in addition to supporting the down-hole assembly 11, has an inner-conductor 19 which is insulated from the outer sheath 21 which acts as a common conductor. The cable drum shaft is provided with slip rings 23, with associated brushes 25, through which electrical signals are transmitted to and from the cable conductors to the down-hole assembly 11 and to components of the above-ground equipment, indicated generally by the block 27. The first tubing string 13 is disposed together with second and third tubing strings 29, 31 within a typical uncased earth borehole 33. The tubing strings are assumed to be cemented in the borehole, but for clarity, the cement is not indicated in the drawings.

The sections of the down-hole assembly 11 as shown by FIG. 1 may include, by way of illustration, reading from top to bottom, a cable head 35, a collar locator section 37, an orienter motor section 39, a magnetic tool section 41 and a perforator device section 43. Secured on the down-hole assembly 11 in a conventional manner between the collar locator section 37 and the orienter motor section 39 are a set of conventional drag springs 45. Also secured on the down-hole assembly 11 in a conventional manner immediately above the magnetic tool section and immediately above the perforator device 43 are respective sets of conventional centralizing springs 47, 49.

The various sections of the down-hole assembly 11 are coupled together and appropriately sealed against entry of well fluids, all in accordance with conventional down-hole tool practices. The upper sections of the down-hole assembly, namely the collar locator section 37 and the orienter motor section 39 are of course movable up or down in the tubing string 13, but they are prevented by the drag springs 49 from having any rotational movement in the tubing 13. The lower sections of the down-hole assembly 11, namely all sections below the orienter motor section 39, are fixed to an output shaft 51 of the orienter motor section 39. The centralizer springs, 47, 49 act to maintain the lower sections centered within the tubing 13, but they do permit the lower sections 41, 43 to rotate within the tubing 13.

As shown in FIG. 6 the above-ground equipment (included within the block 27 of FIG. 1) includes a regulated direct current power supply 53, a first coupling capacitor 55, a first filter 57, a first rate meter 59, a second coupling capacitor 61, a second rate meter 63, a recorder 65, a third coupling capacitor 67, and a second filter 69. The regulated direct current power supply 53 may be of a conventional type capable of supplying about one hundred eighty volts at its output. The power supply output is connected via lead 71 to the center conductor 19 of the cable 15.

The above-ground equipment provides three channels. The first channel may be termed the sensor orientation signal channel; the second channel may be termed the perforator position indicator channel; and the third channel may be termed the magnet drive motor speed verifier channel. The recorder 65 is of the two pen strip chart type and has two channels, one for each pen. In the sensor orientation signal channel, the second coupling capacitor 61 is connected to the cable inner conductor 19 and in series with the input of a rate meter 63, the output of which is connected to the input of one channel of the recorder 65. In the perforator position indicator channel, the third coupling capacitor 67 is connected to the cable inner conductor 19 and in series with the input of the low pass filter 69, the output of which is connected to the input of the other channel of the recorder 65. In the magnet drive motor speed verifier channel, the first coupling capacitor 55 is connected to the cable inner conductor 19 and in series with the input of the filter 57, the output of which is connected to the first rate meter 59.

As shown in FIG. 6, the down-hole assembly 11 (of FIG. 1) includes the collar locator 37; the orienter motor drive section 39 (of FIG. 1) including orienter motor 71, voltage regulator 73, choke 75, bypass capacitor 77, first diode 79, first current limiting resistor 81, and perforator position signal generator 83; perforator device section 43 (of FIG. 1) including gun detonator 85 and second diode 87. The down-hole assembly 11 further includes magnetic tool section 41 (of FIG. 1) including a magnet drive motor circuit, a magnet drive motor speed verifier circuit and a sensor orientation signal circuit. The magnet drive motor circuit comprises magnet drive motor 89, transistor 95, second current limiting resistor 115 and first Zener diode 117. The magnet drive motor speed controller and verifier circuit comprises filter and coupling capacitor 91, second Zener diode 93, transistor 95, pulse rate to DC generator 97, first operational amplifier 99, and voltage reference 101. The sensor orientation signal circuit comprises receiver coil 103, second operational amplifier 105, Hall Effect switch 107, phase comparator and filter 109, voltage controlled pulse generator 111, and coupling capacitor 113.

The collar locator 37 is connected in parallel with the cable inner conductor 19 to ground. A series circuit may be traced from the cable inner conductor 19 through the choke 75, the orienter motor 71, and via leads 119, 121 through the magnet drive motor 89 and through the transistor 95 and via lead 124 and through the resistor 115 and the first Zener diode 117 to ground. A filter capacitor 163 is connected in parallel with the Zener diode 117. The combination of Zener diode 117 and filter capacitor 163 provides a regulated voltage supply for various downhole components. The voltage regulator 73 is connected in parallel with the orienter motor 71. The bypass capacitor 77 and the first diode 79 are connected in parallel across the series combination of the choke 75 and the orienter motor 71. A series circuit may be traced from the cable inner conductor 19 via first diode 79, lead 119, second diode 87 and the gun detonator 85 to ground. The first and second diodes 79, 87 are poled to conduct in the direction away from ground. The perforator position signal generator 83 includes a ring 123 which is fixed to the orienter motor output shaft (not shown) and rotates therewith. A first contact 125 rides on a portion of the ring 123 which is continuously conductive around the ring peripheral surface. The first contact 125 is connected to ground. A second contact 127 rides on a portion of the ring 123 wherein the conductive portion is interrupted by a plurality of insulating segments 129 for a purpose to be hereinafter explained. The second contact 127 is connected via current limiting resistor 81 to lead 119.

Receiver coil 103 has its output connected via the second operational amplifier 105 to one input of phase comparator and filter 109. The output of Hall Effect switch 107 is connected to another input of the phase comparator and filter 109, the output of which is connected to the input of voltage controlled pulse generator 111 the output of which is connected via capacitors 113, 91 and 77 to the cable inner conductor 19. The output from the Hall Effect switch 107 is also connected via lead 131 to the input of pulse rate to DC generator 97 the output of which is connected via first operational amplifier 99 and lead 133 to the base of transistor 95. Voltage reference 101 is connected via lead 135 to an input of the first operational amplifier 99.

The operation of the borehole tool orienting apparatus in accordance with a preferred embodiment of the invention may now be considered.

The magnet drive motor 89 acts to rotate an assembly of permanent magnets 136 and thus generate a moving magnetic field. As shown in FIGS. 2–5, the permanent magnet assembly 136 is made up of four bar magnets 137 which are carried by a cylindrical housing 139 made of non-magnetic material, for example, aluminum. Each magnet may be typically about six inches long and 4/10 inches in diameter and is received by a respective bore in the housing 139. The magnets are symmetrically disposed 90° apart about the housing longitudinal axis and parallel thereto, and are fixed to the housing in any suitable manner, for example, by set screws. The housing 139 is carried by a shaft 141 which is journaled by suitable means (not shown) on pole pieces 143 which are fixed and carried by the housing 147 of the magnetic tool section 41. The output shaft 145 of magnet drive motor 89 is fixed by suitable means (not shown) to the shaft 141 so as to drive same. The Hall Effect sensor 107 is fixed and carried by the housing 147 and has a detector element 149 disposed adjacent the path of rotation of four small magnets 151 that are carried by a non-magnetic disc 153 which is fixed to rotate with shaft 145. These small magnets, which may be typically about ⅛ inch diameter and ¼ inch long, are each disposed in a predetermined position with respect to a corresponding generator magnet 137 and are poled in the same respective manner, as indicated by FIGS. 3 and 5. The pole pieces 143 are tapered so as to have elongated end faces 155, as indicated by FIGS. 2 and 4 in order that the lines of magnetic force will be focused to cause the north and south poles of the magnets 137 to be alternately predominant.

To perform an orienting operation, the downhole assembly 11 is lowered inside the tubing string 13 to be perforated and into the borehole 33 to the desired depth within the production zone. The depth positioning is done in a conventional manner utilizing the collar locator 37 along with borehole log information that was previously obtained. After the downhole assembly 11 has been positioned at the desired depth, the orienting apparatus is energized so that orientation recording operations may begin. The orienter motor 71 then starts running, so that the magnetic tool section 41 and the perforator device section 43 begin rotation. The speed of orienter motor 71 is such that the magnetic tool section 41 will scan one full revolution about every three minutes, or at about 2° per second.

The recording operation is arbitrarily started from whatever azimuthal position the magnetic tool section 41 happens to be in when the apparatus is energized. As hereinbefore mentioned, the recorder has two pens, the first of which makes a first trace on the strip chart in accordance with the output of the sensor orientation signal channel and the second of which makes a second trace in accordance with the output of the perforator position indicator channel. A typical strip chart is shown schematically in FIG. 7, wherein the right hand, or first trace 157 was produced by the first recorder pen and the left hand, or second trace 159 was produced by the second recorder pen. The numbers at the left of the chart correspond to twenty-four equal intervals in a single scanning revolution, and are thus each 15 scanning degrees apart.

The permanent magnet assembly 136 is rotated at a predetermined speed which is preferably in the range of 1,200-1,500 rpm. Rotation of the permanent magnet assembly 136 creates a moving magnetic field which, but for the presence of ferrous anomalies such as external pipe strings 29, 31, would be generally symmetrical about the longitudinal axis of the permanent magnet assembly. Because of the alternate poling of the magnets 137, the generated moving magnetic field not only varies in amplitude but also has polarity reversals, so that the magnetic field variation is generally in the form of a sine wave.

The receiver coil 103 typically has about 5,000 turns and is disposed with its longitudinal axis normal to the rotational axis of the permanent magnet assembly 136. Because of its relative disposition, no signal is induced in the receiver coil except that due to distortion of the generated magnetic field resulting from the presence of an anomaly. When signal is induced in the receiver coil 103, it has generally the same wave form as that of the generated magnetic field, but the amplitude of such induced signal varies as to the radial position of the receiver coil relative to the anomaly is varied. The receiver coil output is fed via operational amplifier 105 to one input of the phase comparator and filter 109.

The Hall Effect switch is a commercially available device which will change its conductive state when subjected to the presence of alternate magnetic poles. Thus, as each magnet 151 passes the detector element 149, the Hall Effect switch 107 changes its conductive state. Since the small magnets 151 have a predetermined orientation with respect to the generator magnets 137, the resulting square wave that is generated by the Hall Effect switch 107 defines a phase relationship relative to the receiver coil output which is in fact indicative of the angular position of the axis of receiver coil 103 relative to the present anomaly (external pipes 29, 31). The square wave output of the Hall Effect switch 107 is fed to the other input of the phase comparator and filter 109 to produce a direct current output signal whose amplitude and polarity is indicative of the angular position of the receiver coil axis relative to the present anomaly (external pipes 29, 31). The direct current output of the phase comparator and filter 109 is fed to the voltage control pulse generator 111 which generates output pulses, the frequency or rate of which is proportional to the polarity and amplitude of the direct current signal. The output of the voltage controlled pulse generator 111 is fed via capacitors 113, 91, 77 to the inner conductor 19 of the cable 15, which takes it to the above-ground equipment. This signal, which is the sensor orientation signal, is then fed via the second coupling capacitor 61 to the rate meter 63 which integrates the pulses and delivers to the recorder 65 a signal which varies in magnitude proportional to the pulse rate, which in turn is a function of the angular or azimuthal position of the receiver coil 103 relative to the present anomaly (external pipes 29, 31). The recorder 65 then produces the first chart trace 157 as the scanning operation proceeds.

As the magnetic tool section 41 performs its scanning operation, the ring 123 of the perforator position signal generator is also rotating at the same rate of about 2° per second, or about one revolution per three minutes. The ring 123 is continuously connected to common or ground by means of the first contact 125 which continuously rides on the conductive portion of the ring. The second contact 127 rides the conductive portion of the ring 123 during spaced intervals within each scanning revolution, and during these conductive intervals, the current limiting resistor 81 is connected via contacts 127, 125 to ground. These conductive intervals are, however, interrupted by the presence of the insulating segments 129. There are twenty-three insulating segments 129 disposed with their outer surfaces on the cylindrical peripheral surface of the ring 123 such that there is a junction between a trailing edge of an insulating segment and the leading edge of a ring conductive portion at each 15° interval of the ring surface except at one place, where the interval is 30° for a purpose to be hereinafter explained. These junctions are represented on the chart of FIG. 7 by the numbers 1 through 24 (with only odd numbers being shown and with a gap indicating no junction at position 3).

Each time the second contact 127 arrives at a junction, the regulated direct current power supply 53 is shunted via current limiting resistor 81 to ground. This shunting action produces a slight but abrupt change in direct current load current resulting in the production of a transient signal which is immediately sensed above ground by the perforator position indicator channel. The transient signal is transmitted from the cable 15 via the third coupling capacitor 67 and low pass filter 69 to the recorder second pen which produces the second trace 159 of FIG. 7. The low pass filter 69 acts, of course, to exclude signals other than the desired transient. An amplifier within the recorder 65 is assumed to include suitable conventional means for shaping the transient signals to the sharp marker or position indicator pulses 161 that appear on the recorder second trace 159. This amplifier is also assumed to include suitable conventional means to exclude the unwanted or extraneous transient signal that is produced when the second contact 127 arrives at a junction at the conductive portion trailing edges and the insulated segment leading edges. The perforator position indicator channel or system described herein is like that disclosed in U.S. Pat. No. 3,307,642.

The recording operation will proceed for a sufficient time to produce position marker pulses 161 for at least one complete revolution of the magnetic tool section 41 and including at least two gaps in the position marker pulse train. It being known that the position marker gaps always occur at position three, these gap positions may be numbered 3 on the chart and then the rest of the position numbers may be properly applied to the chart. The chart positions are now definitely correlated with the aforementioned junction positions on the ring 123, and therefore also with the corresponding magnetic tool section positions. Thus, at the instant the contact 127 arrived at a given junction, as represented by a position marker pulse on the chart, the first trace recorder pen was indicating at the chart position the polarity and amplitude of the sensor orientation signal as seen by the magnetic tool section 41 at the same instant. It is thus apparent that the recorder second trace 159 provides position indicator markers 161 which positively correspond to the orientation of the magnetic tool section 41 and are positively correlative with the recorder frist trace 157.

The longitudinal end portions of the receiver coil 103 may be designated the right and left end portions as shown in FIG. 2. Now assume that the perforator device section 43 (as shown in FIG. 1) has been preoriented with respect to the receiver coil 103 so that the right end of the receiver coil points in the direction opposite to that of the guns or shaped charges of the perforator device section 43. Then, looking at the first recorder trace 157 of FIG. 7, the point A is furthest from the second trace 159 and is the point where the right end of the receiver coil 103 is looking directly away from the center of the present anomaly (tubing strings 29, 31). The point B is nearest the second trace and is the point where the right end of the receiver coil 103 is looking directly at the center of the present anomaly (and consequently the guns or shaped charges are looking directly away from the center of the present anomaly, tubing strings 29, 31). Thus, the positions in the region of position 7 on the second trace 159 are the desirable firing positions. Accordingly, the scanning operation is stopped when position 7 is reached.

In order to actually fire the guns or shaped charges of the perforator device section 43, it is only necessary to momentarily reverse the polarity of the direct current power supply (by conventional means not shown) so that current may pass from ground through the gun detonator 85, diodes 87, 79 to the cable inner conductor 19 and thence up-hole to the power supply 53 and again to ground.

The magnet drive motor 89 is a direct current motor which is subject to speed variations such that effective speed regulation must be provided in order to obtain a reliably usable output from the phase comparator and filter 109. Such regulation is provided by the magnet motor speed controller and verifier circuit hereinbefore mentioned. Output from the Hall Effect switch 107 is supplied via lead 131 to the pulse rate to DC generator 97 the output of which is a direct current signal having a small sawtooth waveform superimposed, which latter signal is fed to operational amplifier 99 which also receives an input from voltage reference 101 and acts as a voltage comparator. During time periods when the magnitude of the pulse rate to DC generator output exceeds the reference voltage, the resultant output of the operational amplifier 99 is such as to render the transistor 95 non-conductive. Conversely, during time periods when the magnitude of the pulse rate to DC generator output is less than the reference voltage, the resultant output of the operational amplifier 99 is such as to render transistor 95 conductive. Thus, the transistor 95 is switched on and off at the rate at which the Hall Effect switch is operating, which is twice per magnet drive motor revolution; but the ratio of the conductive to non-conductive time for transistor 95 is the same as that of the time during which the magnitude of the output of pulse rate to DC generator is less than the reference voltage to the time during which it is more. The more of the time that the transistor 95 is conductive, the more armature current is supplied to the magnet motor. If, for any reason, the magnet drive motor speed decreases below the regulated speed, the output of the pulse rate to DC generator decreases, causing the total time during which the transistor 95 is rendered conductive to increase, thus supplying more armature current to the magnet drive motor 89 and increasing its speed. If the speed of the magnet drive motor for any reason increases beyond the regulated speed then the output of the pulse rate to DC generator increases, causing it to exceed the reference voltage, and consequently, decreasing the time during which the transistor 95 is conductive, thus reducing the armature current of the magnet drive motor and slowing it down.

It is highly desirable that the operator of the above-ground equipment be able to verify that the magnet drive motor 89 is running at the desired speed. This is accomplished in the magnet drive motor speed verifier channel hereinbefore mentioned. The turning of the transistor 95 on and off at a rate which is a function of the magnet drive motor speed causes a ripple to occur on the line voltage or signal (which is transmitted to above-ground equipment via cable inner conductor 19) which is also then a function of the magnet drive motor speed. This ripple voltage is separated from the line signal in the above-ground equipment third channel by filter 57 and is fed to rate meter 59 which can be calibrated to read magnet drive motor speed. The regulated speed of the magnet drive motor 89 can be adjusted by adjustment of the voltage reference 101.

The preferred embodiment of the present invention as shown and described herein demonstrates one way in which the important concepts involved in the invention may be applied in practice to achieve the desired results. It is realized, of course, that the actual physical configuration of the apparatus used to apply said concepts may certainly be varied in a number of ways that will be apparent to those skilled in the art. For example, it is believed that the permanent magnet configuration shown and described is the best one, but it is possible that a greater or lesser number of magnets could be used and that the magnets not be alternately poled, although the result would be a less effective tool. In the broadest sense, it is theoretically only necessary that the permanent magnet configuration should create a moving magnetic field. Thus, it is conceivable that the magnet configuration could be osciallated or reciprocated instead of rotated. Also, the receiver means, instead of being a single receiver coil 103, could be a plurality of coils; the coil or coils could have any disposition so long as measurable signals are induced therein under the condition when the moving magnetic field is distorted due to the presence of a ferrous anomaly; further, the receiver means may, if desired, be a magnetometer or a Hall Effect magnet field sensor.

In some cases it may be desirable to verify the results obtained from the borehole orienting apparatus hereinbefore described. This may be accomplished by use of a separate means for generating a moving magnetic field, which separate means is lowered in another tubing string to the predetermined depth. The receiver means and associated apparatus is then utilized to operate on signals induced from the separate moving magnetic field source instead of the one included in the downhole assembly.

Although the Hall Effect switch shown and described provides a convenient and effective means to generate the desired signals, it will be apparent to those skilled in the art that there are other means available that could be satisfactorily used.

It is, of course, apparent that the tool being oriented can be other than a perforator gun.

The foregoing disclosure and the showings made in the drawings are merely illustrative of the principles of this invention and are not to be interpreted in a limiting sense.

What is claimed is:

1. Borehole tool orienting apparatus comprising:

a. a downhole assembly and means for lowering same to a predetermined depth in a borehole; said downhole assembly including:

i. a permanent magnet assembly made up of one or more permanent magnets, ii. means for imparting motion to said permanent magnet assembly to generate a moving magnetic field, iii. receiver means disposed in relation to said moving magnetic field so that substantially no signals are induced therein under the condition when said moving magnetic field is substantially undistorted but measurable signals may be induced therein under the condition when said moving magnetic field is distorted due to the presence of a ferrous anomaly, iv. means for rotating said receiver means to produce an azimuthal scan whereby there is induced in said receiver means signals which are a function of the azimuthal location of a ferrous anomaly.

2. The apparatus of claim 1 wherein said permanent magnet assembly has a longitudinal axis disposed parallel to the longitudinal axis of said downhole assembly and the means for imparting motion is a motor which rotates said permanent magnet assembly about its longitudinal axis.

3. The apparatus of claim 2 wherein said permanent magnet assembly is made up of an even number of magnets symmetrically disposed about said longitudinal axis, with adjacent magnets being oppositely poled.

4. The apparatus of claim 2 wherein said downhole assembly further includes means for producing signals which are a function of the relative position of said permanent magnet assembly and said receiver means.

5. The apparatus of claim 4 wherein said downhole assembly further includes means for producing signals which are positively related to azimuthal positions of said receiver means.

6. The apparatus of claim 2 wherein said downhole assembly further includes a perforating device and is suspended within a first tubing string and wherein said ferrous anomoly is one or more additional tubing strings.

7. The apparatus of claim 4 wherein said means for producing signals, which are a function of the relative position of said permanent magnet assembly and said receiver means, is a Hall Effect switch.

8. The apparatus of claim 4 wherein said signals which are a function of the relative position of said permanent magnet assembly and said receiver means is fed to one input of a phase comparator and filter and signals which are a function of those induced in said receiver means are fed to another input of said phase comparator and filter, so as to produce output signals which are a function of the azimuthal position of said receiver means relative to the present ferrous anomaly.

9. The apparatus of claim 3 wherein said receiver means is a single coil whose longitudinal axis is normal to the longitudinal axis of said permanent magnet assembly.

10. The apparatus of claim 2 wherein there is provided a switch device connected in series with said magnet drive motor and means for controlling said switch device so as to regulate the speed of said drive motor.

11. The apparatus of claim 10 wherein said switch device is a transistor and said controlling means provides a bias signal for said transistor, which bias signal is derived from a comparison of a signal which is a function of magnet drive motor speed with a reference signal.

12. The apparatus of claim 10 wherein there is derived from the operation of said switch device a signal which is a function of magnet drive motor speed and means are provided to present said signal in above ground equipment to verify to an operator the magnet drive motor speed.

* * * * *